US006940452B2

(12) United States Patent
Munoz et al.

(10) Patent No.: US 6,940,452 B2
(45) Date of Patent: Sep. 6, 2005

(54) REDUCING CO-CHANNEL INTERFERENCE IN SATELLITE COMMUNICATIONS SYSTEMS BY ANTENNA RE-POINTING

(75) Inventors: Michael S. Munoz, Redondo Beach, CA (US); Garrick J. Harmon, Long Beach, CA (US); Raymond M. Nuber, Rancho Palos Verde, CA (US); David L. Brundrett, Culver City, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 51 days.

(21) Appl. No.: 10/673,533

(22) Filed: Sep. 29, 2003

(65) Prior Publication Data

US 2005/0068230 A1 Mar. 31, 2005

(51) Int. Cl.[7] ..... H01Q 3/00
(52) U.S. Cl. ..... 342/359; 342/75; 343/757
(58) Field of Search ..... 342/359, 422, 342/75; 343/754, 757

(56) References Cited

U.S. PATENT DOCUMENTS

| | | | | |
|---|---|---|---|---|
| 4,704,611 A | * | 11/1987 | Edwards et al. | 342/367 |
| RE32,905 E | | 4/1989 | Baran | |
| 5,936,588 A | | 8/1999 | Rao et al. | |
| 6,014,115 A | | 1/2000 | Ghaby et al. | |
| 6,021,309 A | | 2/2000 | Sherman et al. | |
| 6,088,416 A | | 7/2000 | Perahia et al. | |
| 6,175,340 B1 | * | 1/2001 | Olds et al. | 343/893 |
| 6,281,839 B1 | * | 8/2001 | Nielsen | 342/372 |
| 6,400,315 B1 | * | 6/2002 | Adler et al. | 342/359 |
| 6,473,035 B2 | * | 10/2002 | Fang | 342/359 |
| 2002/0061730 A1 | * | 5/2002 | Hart et al. | 455/12.1 |

OTHER PUBLICATIONS

J. Ruze; "Lateral–feed Displacement in a Paraboloid;" Mar. 11, 1965; pp. 660–664.

W.A. Imbriale, P.G. Ingerson, W.C. Wong,; "Large Lateral Feed Displacements in a Parabolic Reflector;" May 8, 1974; pp. 742–745.

* cited by examiner

*Primary Examiner*—Dao Phan
(74) *Attorney, Agent, or Firm*—Posz Law Group, PLC

(57) ABSTRACT

A system and method for increasing the performance of a satellite communication system by using a multivariate analysis approach to optimize the pointing of the boresight of a satellite-mounted antenna. Optimizing the pointing of the boresight of the antenna minimizes sidelobe generation, and thus Co-Channel Interference (CCI) in geographic areas served by the system. By minimizing CCI, the overall system performance of the communication system is optimized. To optimize the pointing of the boresight of the antenna, the overall performance of the satellite communication system is determined, and the boresight of the antenna is iteratively repointed in the direction of increasing system performance until the optimized boresight pointing is determined. Alternatively, the frequency re-use plan of the satellite communication system may be analyzed to determine a high density cell region and the boresight may be pointed to the high density cell region.

18 Claims, 4 Drawing Sheets

REDUCING CO-CHANNEL INTERFERENCE IN SATELLITE COMMUNICATIONS SYSTEMS BY ANTENNA RE-POINTING

BACKGROUND OF THE INVENTION

The present invention generally relates to satellite communication systems. In particular, the present invention relates to optimizing communication over a satellite communications system by adjusting the boresight of an antenna on the satellite in response to system parameters.

A typical satellite communication system includes a satellite which communicates between various points on the earth's surface. Typically, a multibeam satellite communications system geographically divides the earth's surface into a number of circular or hexagonal geographic areas called cells. Each cell is serviced by different communication channels on the satellite. The communication channel between the satellite and the cell is typically referred to as a spot beam.

Because signals being transmitted at the same frequency interfere with one another, in a typical satellite communication system, spot beams in adjacent cells are operated at different frequencies. Thus, each spot beam is typically surrounded by a number of spot beams operating at different frequencies than the given spot beam. The geographic pattern of the frequencies of the spot beams is often referred to as a frequency re-use pattern. Typical frequency re-use patterns are 4 to 1 and 7 to 1 re-use patterns. In a 4 to 1 re-use pattern, for example, four different frequencies are employed to create the frequency re-use pattern.

Typically, a satellite communications system may produce several spot beams from a single satellite-mounted antenna. For example, the satellite-mounted antenna may be parabolic or spherical and multiple feeds may supply signals to a single antenna. The signals supplied by the multiple feeds may be directed to the desired cells using the geometry of the antenna. That is, the multiple feeds may be positioned to impinge on the antenna at different locations and/or incidence angles and thus be reflected to their desired cells. Thus, in this way, a single antenna structure may supply numerous spot beams.

Although a single antenna structure may supply several spot beams, each antenna has only a single boresight. The antenna's boresight is typically described as the "axis" of the antenna and is usually the location of greatest signal strength for the antenna. For example, in a spherically symmetric antenna, the boresight would be directed straight outward from the center of the antenna in the concave direction. Essentially, an antenna has only a single boresight because an antenna may only be mechanically oriented at one position at a single instance in time. The antenna's boresight is typically directed to the point on the earth's surface closest to the satellite, which is often called the sub-satellite point.

As mentioned above, signals being transmitted at the same frequency may interfere with one another. Although each spot beam is directed toward a single cell on the earth's surface, sidelobes of any spot beam may also occur. A sidelobe may be defined as the transmission of any power by the antenna in any direction other than the main, desired direction. For example, for any spot beam, the desired transmission direction is to its corresponding cell on the earth's surface. A sidelobe occurs where a fraction of the transmission power is not directed toward the desired cell and may fall anywhere on the earth's surface. The sidelobe may then interfere with communication in other cells. For example, a spot beam directed to cell A generates a sidelobe at a specific frequency that impinges on cell B. If cell B operates at the same frequency as cell A, then cell A's sidelobe interferes with operation in cell B. The interference may adversely affect the performance of the communication system and cause degraded communication performance, such as an increased bit error rate or a lower signal to noise ratio. The interference between two or more cells using the same frequency is often referred to as Co-Channel Interference (CCI).

The gain magnitude of sidelobes typically increases with angular deviation of the spot beam from the antenna's boresight. Thus, a spot beam directed to a cell at an angle of 7 degrees from the boresight of the antenna typically has a higher sidelobe level than a spot beam directed to a cell at an angle of 2 degrees from the boresight of the antenna. In other words, the strength of the sidelobes of spot beams scanned further from the antenna's electrical boresight is typically greater than the strength of the sidelobes of beams near the antenna's electrical boresight.

Additionally, sidelobe power typically diminishes with distance from the spot beam center. For example, take a system with three cells, cell A, cell B, and cell C, where the distance between cell A and cell B is less than the distance between cell A and cell C. If a spot beam is directed toward cell A and generates sidelobes, the sidelobes generally interfere with cell B more than cell C because cell B is closer to cell A.

Thus, for dense frequency re-use patterns, such as the 4 to 1 frequency re-use pattern mentioned above, because co-channel cells are spaced closely together, the CCI experienced by the cells may be particularly intense. That is, because cells utilizing the same frequency band are close together, the main lobe of each spot beam may be contaminated by the sidelobes of the surrounding spot beams utilizing the same frequency band. Conversely, in areas with a low density of antenna spot beams, interference generated by CCI decreases. This is because the spot beams utilizing the same frequency band are further apart, and the strength of the sidelobes decreases with distance.

Typically, in a satellite communication system frequency re-use plan, the geographic area representing North America is densely covered, often by using a closely-packed re-use plan such as the 4 to 1 frequency re-use plan. Conversely, South American coverage is typically far less dense with most systems only providing coverage on the coasts or at various population centers.

As mentioned above, the satellite's antenna is typically boresighted at a sub-satellite point. Typically the sub-satellite point is on the earth's surface nearest the satellite. Alternatively, the boresight of the antenna may be positioned so that the angular deviation from the boresight of the most distant cell in the frequency re-use pattern is minimized. For example, in a communications system that provides services to both North America and South America, the antenna may be boresighted so that the boresight lies midway between the northernmost cell (Alaska, for example) and the southern most cell (Argentina, for example). Recall that decreasing the angle between boresight and spot beam serves to minimize sidelobe generation, and thus CCI. Consequently, minimizing the maximal angular deviation between boresight and spot beam for the whole frequency re-use pattern serves to minimize the sidelobe generation and CCI for the whole system.

Any minimization of CCI results in an improvement in overall system performance, for example, improved noise floor or improved Bit Error Rate (BER). Consequently, any improvement in CCI is intensely commercially desirable.

Thus, a need has long been felt for a system and method for providing improved CCI for a satellite communication system. A need has especially been felt for such a system that improves CCI, thus providing improved system performance, such as improved noise floor or BER, for example.

SUMMARY OF THE INVENTION

The embodiments of the present invention provide a system and method for increasing the performance of a satellite communication system by using a multivariate analysis approach to optimize the pointing of the boresight of a satellite-mounted antenna. Each of the communication cells generate Co-Channel Interference (CCI) that affects the overall system performance. The optimized pointing of the boresight of the satellite-mounted antenna is determined in any of a variety of ways including calculating the total CCI for the satellite system and then determining the boresight pointing that minimizes the CCI. Alternatively, the frequency re-use plan of the satellite communication system may be analyzed to determine a high density cell region and the boresight may be pointed to the high density cell region. The boresight may be set to a predetermined optimized position or, the pointing of the boresight of the antenna may be readjusted after the installation of the satellite.

DETAILED DESCRIPTION OF THE PREFERRED EMBODIMENTS

The preferred embodiment of the present invention provides a multivariate analysis approach to optimizing the pointing of the boresight of the antenna. By optimizing the pointing of the boresight of the antenna, sidelobe generation, and thus CCI, are minimized. By minimizing CCI, the overall system performance of the communication system is optimized.

As mentioned above, sidelobe generation increases with increasing angular deviation of the spot beam from boresight. Additionally, the interference caused by sidelobes increases with proximity to the spot beam. A preferred embodiment of the present invention takes into account both of these factors to derive an optimized antenna boresight pointing to minimize system-wide CCI.

Figure 1:
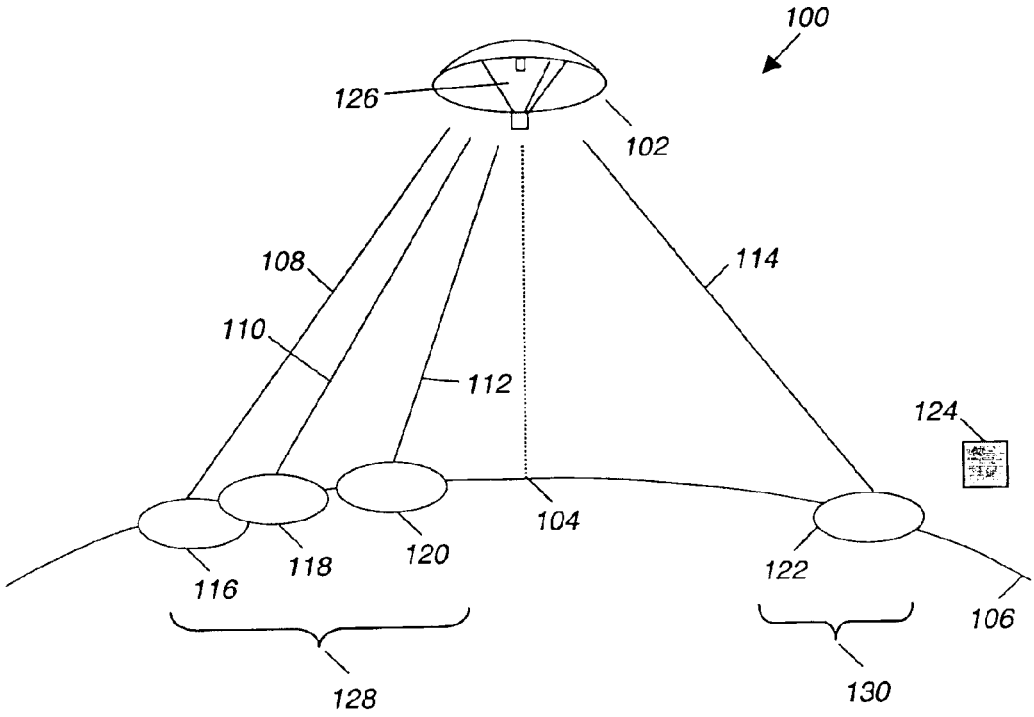
FIG. 1 illustrates a satellite communication system according to a preferred embodiment of the present invention.

FIG. 1 illustrates a satellite communication system 100 according to a preferred embodiment of the present invention. The satellite communication system 100 includes a satellite 102, a sub-satellite point 104, a network control center 124, and an earth surface 106. The satellite 102 includes an antenna 126. The antenna 126 includes reflectors (not shown) for transmitting and receiving. In a preferred embodiment of the present invention, the antenna 126 includes 4 reflectors for transmitting and 4 reflectors for receiving. In a preferred embodiment, the satellite 102 is a geostationary satellite. The earth surface includes a first cell 116, a second cell 118, a third cell 120, and a fourth cell 122. A spot beam is directed from the antenna 126 of the satellite 102 to each of the cells 116–122. That is, a first spot beam 108 is directed to the first cell 116, a second spot beam 110 is directed to the second cell 118, a third spot beam 112 is directed to the third cell 120, and a fourth spot beam 114 is directed to the fourth cell 122. The network control center 124 controls the operation of the satellite 102 as further described below. The network control center 124 may be located on the earth surface 106 or on the satellite 102.

The antenna 126 is oriented so that the electrical boresight of the antenna 126 is directed towards the sub-satellite point 104. The sub-satellite point 104 is the closest point on the earth surface 106 to the satellite 102. Alternatively, the sub-satellite point 104 may be expressed as the "straight down" point from the satellite 102 to the earth surface 106, or the point on the earth surface 106 where the angle made by the boresight of the antenna 126 is perpendicular to the earth surface 106.

In the satellite communication system 100, the sub-satellite point 104 is often located well away from high density areas (e.g. areas of concentrated spot beams). In a preferred embodiment of the present invention, an area of high density 128 may be illustrated by the first cell 116, the second cell 118, and the third cell 120. An area of low density 130 may be illustrated by the fourth cell 122.

As described above, the sidelobe level generated by a spot beam varies with the spot beam's angular deviation from the electrical boresight. For example, the sidelobe level generated by the first spot beam 108 is greater than the sidelobe level generated by the third spot beam 112 because the first spot beam 108 is at a greater angular deviation from boresight.

In a preferred embodiment, a frequency re-use pattern is employed by the satellite communication system 100. As mentioned above, frequency reuse allows non-adjacent cells to transmit over the same frequency bandwidth because spot beams are spatially focused and the sidelobe strength experiences rapid fall off with distance. By way of example, the first spot beam 108 and the third spot beam 112 may use the same frequency for transmitting and receiving signals because the first cell 116 and the third cell 120 are non-adjacent cells. In order to prevent interference, the second spot beam 110 uses a different frequency than the frequency used by either the first spot beam 108 or the third spot beam 112 because the second cell 118 is adjacent to both the first cell 116 and the third cell 120. The fourth spot beam 114 may use either the frequency used by the first spot beam 108, the second spot beam 110, or the third spot beam 112 because the fourth cell 122 is not adjacent to any other cell. If the first spot beam 108 and the third spot beam 112 utilize the same frequency, the first spot beam 108 and the third spot beam 112 may experience Co-Channel Interference (CCI).

Additionally, if the fourth spot beam 114, third spot beam 112 and first spot beam 108 all employ the same frequency, the CCI generated by the first spot beam is higher in the third spot beam 112 than in the fourth spot beam 114. The CCI is generally higher in the fourth spot beam 114, because the first cell 116 is closer to the third cell 120 than it is to the fourth cell 122.

As mentioned above, pointing the electrical boresight at the sub-satellite point 104 minimizes the maximum angular displacement as a whole experienced by the multiple cells serviced by the satellite communication system 100. Examining alternative pointing configurations, pointing the boresight of the antenna at the fourth cell 122 enables the fourth spot beam 114 to experience improved sidelobe levels, however, the sidelobes generated by spot beams 108–112 are increased. Consequently, the CCI for the system as a whole is worse than in the case when the boresight is pointed at the sub-satellite point 104.

Alternatively, pointing the boresight of the antenna at the first cell 116 enables the first spot beam 116 to experience improved sidelobe levels, however, the sidelobes generated by the fourth spot beam 114 are increased. However, notice that the sidelobes for the second spot beam 110 and potentially the third spot beam 112 are also decreased when the boresight is oriented toward the first cell 116 because the angular deviation from the boresight of the second spot beam 110 and third spot beam 112 is reduced.

Additionally, assume that the first spot beam 108 and the fourth spot beam 114 operate over the same frequency. When the boresight is repointed toward the first cell 116, the sidelobes generated by the fourth spot beam 114 are increased as mentioned above. However, because the sidelobe power diminishes with distance between cells, the effect of the increased sidelobe level of the fourth spot beam 114 on the first cell 116 is low. In other words, because the separation between the first cell 116 and the fourth cell 122 is large, the increased sidelobe level of the fourth spot beam 114 has only a minimal effect on the CCI of the first cell 116.

By recognizing and accounting for the variables of 1) angular deviation from boresight and 2) distance between co-channel cells, a new antenna boresight may be determined in order to minimize system-wide CCI.

Generalizing, in an embodiment of the present invention, the frequency re-use pattern includes at least one area of greater density and at least one area of lesser density. The antenna boresight may be repositioned toward the area of greater density, thus lessening the angular deviation from the boresight of the spot beams servicing the cells in the area of greater density. Repointing the boresight towards the area of greater density causes increased angular deviation from the boresight of the spot beams servicing the cells in the areas of lesser density. Consequently, the spot beams servicing the cells in the areas of lesser density experience increased sidelobe levels. However, the impact on the overall CCI of the system by the increased sidelobe levels generated in the spot beam servicing the cells in the areas of lesser density is small because the cells in the areas of lesser density are geographically and angularly remote from most co-channel cells.

Figure 2:
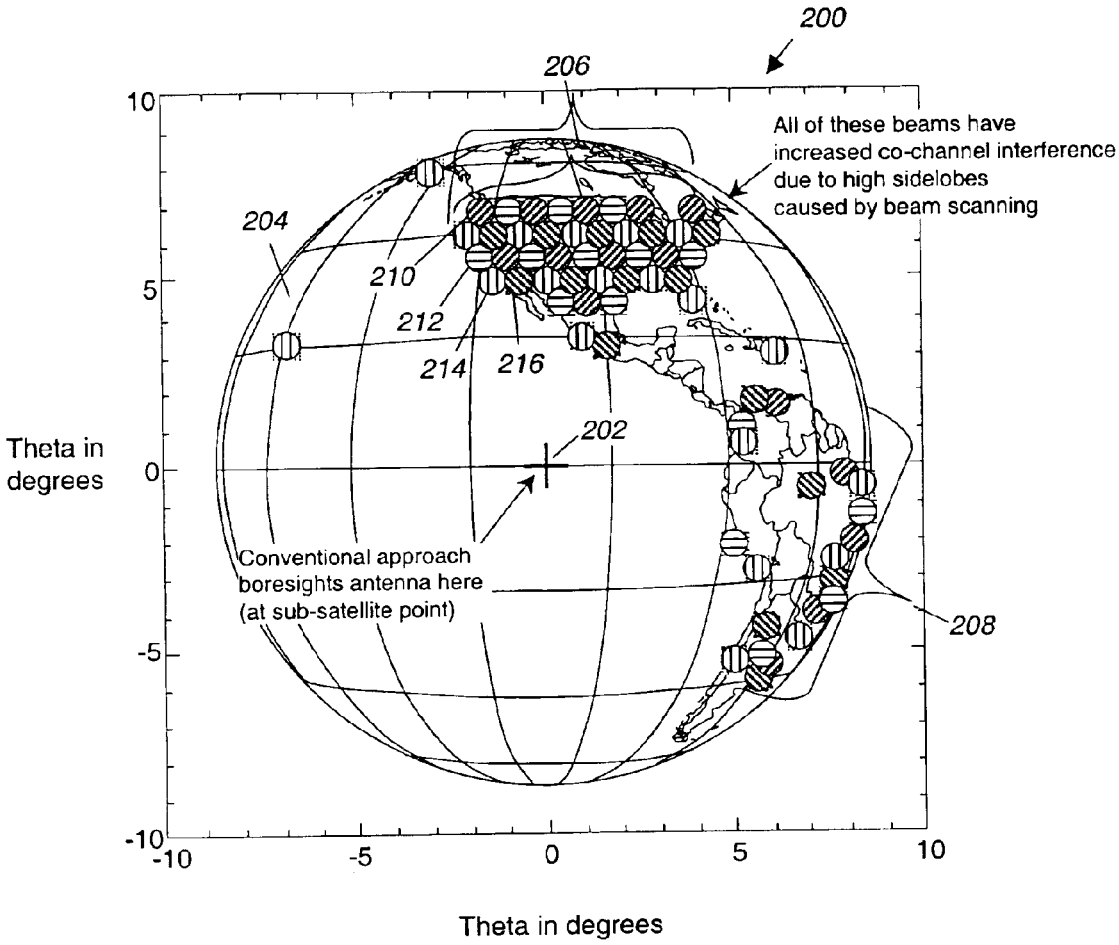
FIG. 2 illustrates a non-optimized boresight pointing plan according to a preferred embodiment of the present invention.

FIG. 2 illustrates a non-optimized boresight pointing plan 200 according to a preferred embodiment of the present invention. The non-optimized boresight pointing plan 200 incorporates the satellite communication system 100 of FIG. 1, that is, the non-optimized boresight pointing plan 200 comprises a sub-satellite point 202, an earth surface 204, an area of high density 206, and an area of low density 208. In FIG. 2, the electrical boresight of the satellite is located at the sub-satellite point 202 on the earth surface 204. Additionally, the communication system of FIG. 2 illustrates a 4 to 1 frequency re-use plan. That is, a first cell 210 operates at a first frequency, a second cell 212 operates at a second frequency, a third cell 214 operates at a third frequency, and a fourth cell 216 operates at a fourth frequency. As indicated, the frequency of each cell in the frequency re-use pattern is illustrated as either the first, second, third, or fourth frequency by the graphical pattern in the cell. That is, the four frequency bands are re-used throughout the geographic area serviced by the non-optimized boresight pointing plan 200. However, it should be noted that an antenna spot beam transmitting at one frequency does not transmit at the same frequency of any adjacent antenna spot beam. For example, in a preferred embodiment of the present invention, a spot beam transmitting at the frequency of the first spot beam 210 may be surrounded by six other spot beams. Each of the six other spot beams do not transmit at the frequency of the first spot beam 210, but instead transmit at one of the frequencies of the second spot beam 212, the third spot beam 214, or the fourth spot beam 216.

The location of the sub-satellite point 202 may have been selected by simply pointing the boresight towards the point on the earth's surface nearest the satellite. Alternatively, the boresight of the antenna may be positioned so that the angular deviation from the boresight of the most distant cell in the frequency re-use pattern is minimized. For example, the angular deviation between the spot beams for Hawaii, Alaska, Maine, Brazil, and Argentina may be minimized.

Figure 3:
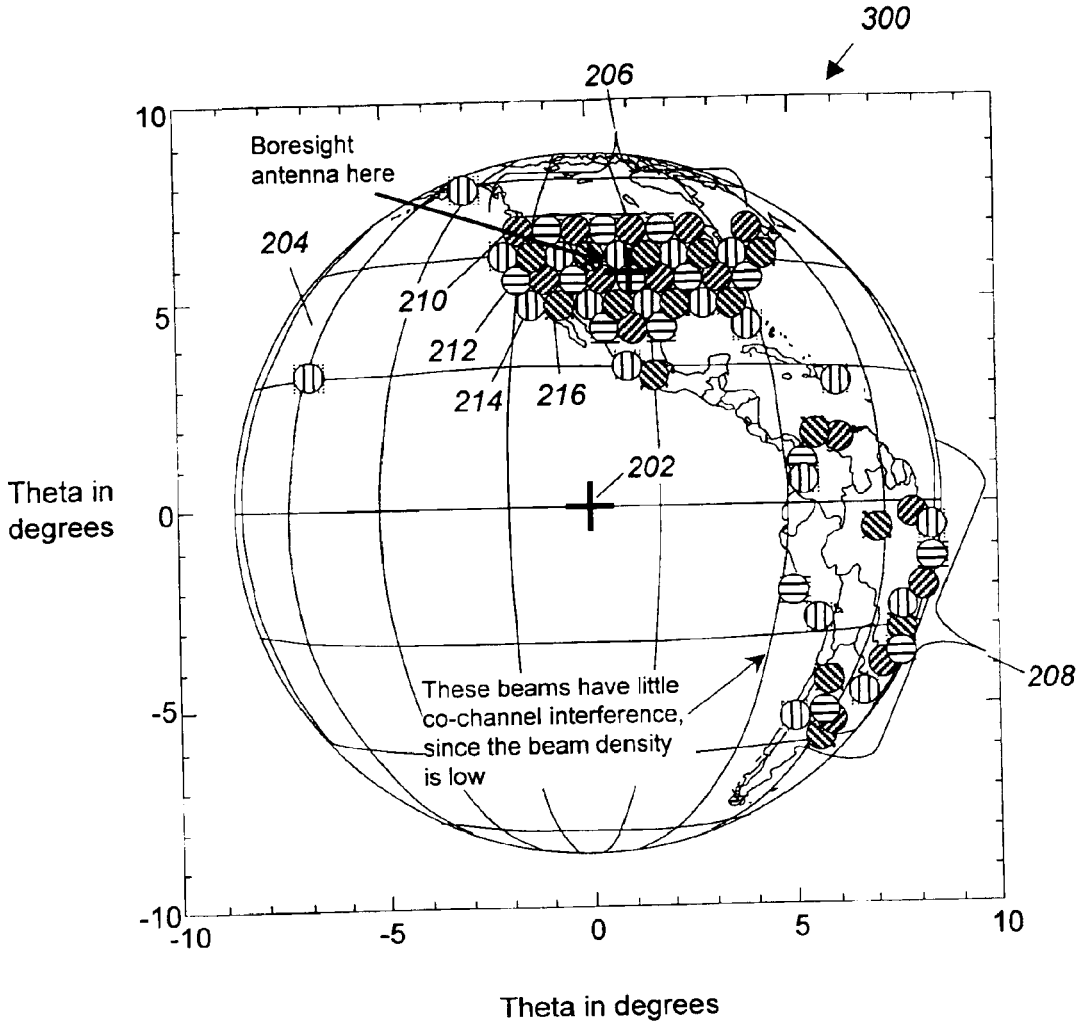
FIG. 3 illustrates an optimized boresight pointing plan according to a preferred embodiment of the present invention.

FIG. 3 illustrates an optimized boresight pointing plan 300 according to a preferred embodiment of the present invention. FIG. 3 incorporates elements of the satellite communication system 100 of FIG. 1 and the non-optimized boresight pointing plan 200 of FIG. 2. FIG. 3 includes the sub-satellite point 202, the earth surface 204, the area of high density 206, the area of low density 208, and the first to fourth spot beams 210–216 of FIG. 2. Additionally, FIG. 3 illustrates an optimized electrical boresight 302. As seen in FIG. 3, comparing the area of high density 206 and the area of low density 208, co-channel cells are closer together in the area of high density 206.

The preferred embodiment of the present invention provides a multivariate analysis approach to optimizing the pointing of the boresight of the antenna in order to minimize system-wide CCI and thus maximize overall system performance. Factors affecting the analysis include 1) increased sidelobe generation with increasing angular deviation of the spot beam from boresight and 2) increased sidelobe interference to co-channel cells in nearer proximity to a spot beam. The preferred embodiment of the present invention takes into account both of these factors to derive an optimized antenna boresight pointing to minimize system-wide CCI.

In one embodiment of the present invention, the contributions to the system-wide CCI for each spot beam are calculated and analyzed. The positioning of the antenna's boresight is then adjusted and the system-wide CCI is recalculated. Using several successive iterative steps and comparing the system-wide CCIs of the various boresight positionings, the optimal positioning of the boresight antenna may be determined. In this embodiment, the cell density is accounted for mathematically rather than explicitly. That is, the actual cell locations are used in determining the contribution of the cells to the overall CCI. Thus, areas of greater and lesser cell density are reflected in the system-wide CCI. Additionally, through repeated experimentation using this embodiment it has been found that the optimal boresight positioning typically includes relocating the antenna boresight to the area of greatest cell density.

In a second embodiment of the present invention, the positions of co-channel cells in the frequency re-use pattern are analyzed to determine regions of low density and high density. Once the region of highest density has been determined, the sub-satellite point is simply centered on the region of highest density.

Referring again to FIG. 3, the optimized electrical boresight 302 is shown relative to the sub-satellite point 202. The optimized electrical boresight 302 shown in FIG. 3 has been determined according to the first embodiment of the present invention, that is, the contributions of each cell in the system have been analyzed and the overall CCI for the system has been minimized. As seen in FIG. 3, the optimized electrical boresight 302 points generally toward the center of the area of high density 206 and has thus been angularly displaced away from the region of low density 208.

As discussed above, displacing the boresight towards the region of high density 206 reduces the sidelobe power generated by the spot beams in the region of high density 206. Thus, the contribution to the system-wide CCI for the spot beams in the region of high density is lowered. However, displacing the boresight towards the region of high density 206 displaces the boresight away from the region of low density 208. Displacing the boresight away from the region of low density 208 increases the sidelobe power generated by the spot beams in the region of low density 208. Although typically increasing sidelobe power increases the system-wide CCI, such is not the case here, because the co-channel cells are spaced widely apart in the region of low density 208. That is, because sidelobe power diminishes with distance from the cell and the spacing between the cells in the region of low density is large, even though the sidelobe power of the spot beams in the region of low density is increased, the contribution to the overall system-wide CCI is minimal.

The system-wide CCI may be optimized for both the transmit direction and the receive direction. However, the CCI may be optimized in only one direction. In an alternative embodiment, only the CCI in the transmit direction or the CCI in the receive direction is evaluated when determining the optimized electrical boresight 302. In another alternative embodiment, the CCI is optimized by utilizing weighting factors. For example, the CCI of the transmit direction is analyzed and is considered in either a greater or lesser percentage than the CCI of the receive direction when determining the optimized electrical boresight 302.

Figure 4:
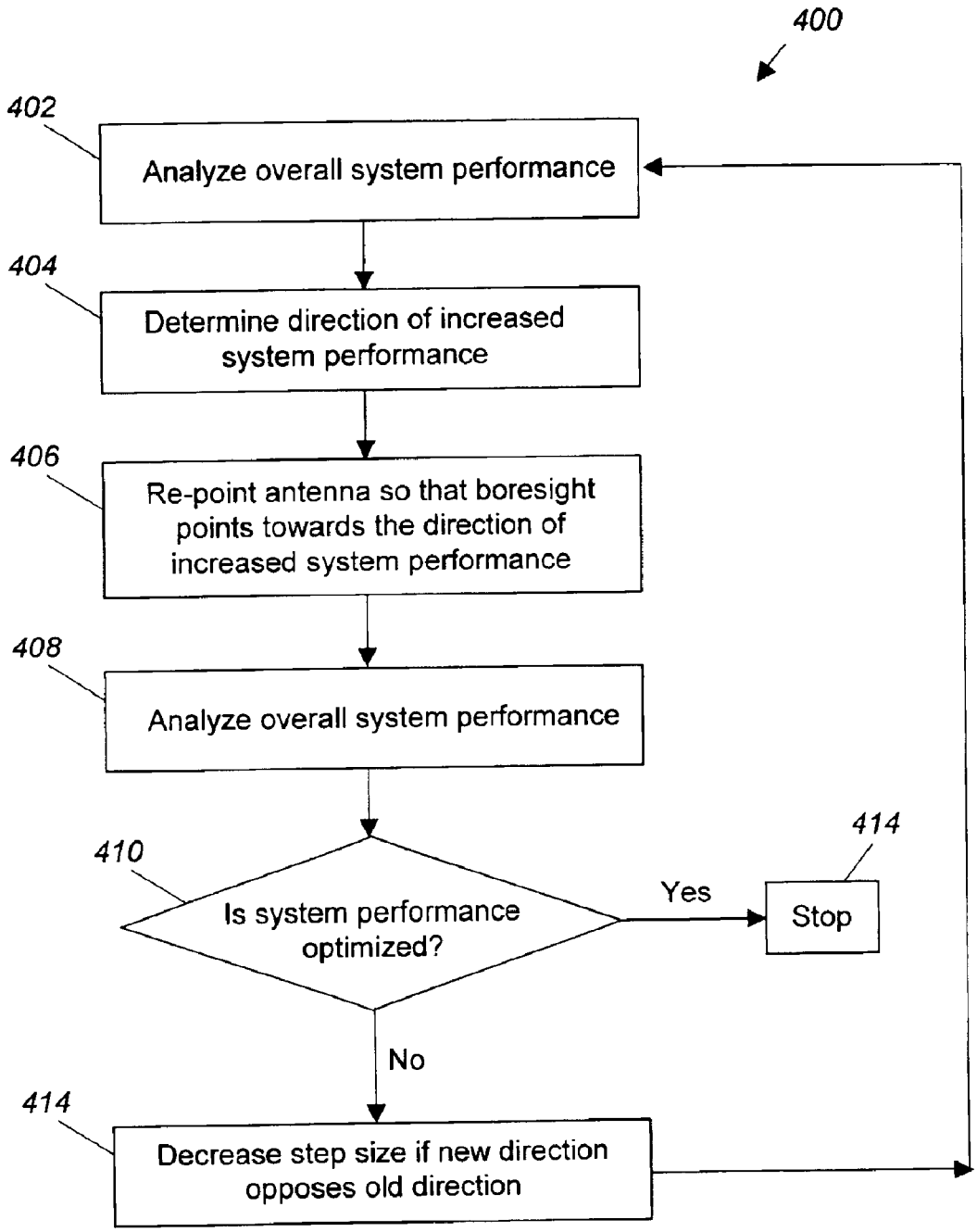
FIG. 4 illustrates a flowchart according to a preferred embodiment of the present invention.

FIG. 4 illustrates a flowchart 400 according to a preferred embodiment of the present invention. The flowchart 400 illustrates a determination of the optimal position for the optimized electrical boresight 302 of the satellite communication system 100.

First, at Step 402, the boresight is directed toward the initial sub-satellite point 202 of FIG. 2. The overall performance of the communication system is then analyzed. For example, the total system-wide CCI, BER, signal to noise ratio, or sidelobe level may be determined. In one embodiment, the CCI may be optimized for either the transmit or the receive direction. In another embodiment, the CCI may be optimized for both the transmit and receive directions. Additionally, the geographic positions of the spot beams, as well as the frequency re-use pattern is determined. By analyzing the positions of the spot beams, areas of high and low density may be determined and the densities of the spot beams may be taken into account when determining the performance of the communication system.

Next, at Step 404, the geographic boresight direction that increases system performance is determined. For example, the direction of increased performance may be an angular displacement toward the region of high density.

At Step 406, the satellite's antennas are re-pointed so that the electrical boresight is directed towards the direction of increased system performance. For example, the boresight may be angularly displaced toward the region of high density. Additionally, as the optimization proceeds, the successive displacements of the boresight may be lessened.

Next, at Step 408, the overall system performance is determined. For example, the overall system-wide CCI may be determined as in Step 402 above.

Then, at Step 410, the overall system performance at the present boresight position is compared to the overall system performance at the previous boresight position. If the system performance has been optimized, then the optimized electrical boresight 302 has been determined and the operation of the flowchart is stopped at Step 412. For example, if no change in the boresight angular displacement yields an improved system-wide CCI, then the angular position of the boresight has been optimized.

Finally, at Step 414, if system performance has not been optimized, then the angular displacement of the present boresight position is compared to the angular displacement of the previous boresight position.

Once the step size has been adjusted, if necessary, control proceeds to Step 404. At Step 404 a new angular displacement of the boresight that yields increased system performance is determined and the optimization proceeds.

The steps in the flowchart 400 may be performed either at the system design stage, or may be automatically adjusted during system operation. That is, in one embodiment, the communications system may be designed to point at an optimized boresight pointing position. That is, the system is installed with a fixed boresight pointing at a predetermined optimal boresight pointing position.

However, in practice, various elements may cause errors in the boresight positioning. For example, radiative or other thermal forces may cause thermal expansion of satellite components thus changing the boresight positioning, the boresight positioning may be disturbed through collisions, or the boresight positioning may simply not have been installed correctly.

In order to counteract these elements, a second embodiment includes the ability to dynamically repoint the boresight. For example, periodically during operation of the satellite, the overall system-wide CCI may be measured and an improved boresight positioning, if any, may be determined. The boresight of the antenna may then be readjusted to point at the improved boresight positioning. The boresight adjustment and the positioning of the boresight may be controlled by the network control center 124, for example. Additionally, if the spot beam pattern is changed the boresight positioning may be readjusted. For example, if service to a cell is discontinued, a new optimized boresight position may be determined.

Thus, the present invention illustrates a system and method for the minimization of the overall system-wide CCI. By minimizing the system-wide CCI, the present invention provides improved operation, such as an improved noise floor or BER, for example. Improving the operation of the satellite communication system may yield improved service and cost effectiveness and is immensely commercially desirable.

While particular elements, embodiments and applications of the present invention have been shown and described, it is understood that the invention is not limited thereto since modifications may be made by those skilled in the art, particularly in light of the foregoing teaching. It is therefore contemplated by the appended claims to cover such modifications and incorporate those features which come within the spirit and scope of the invention.

What is claimed is:

1. A method for increasing system performance of a satellite communication system, said satellite communications system including a satellite having an antenna, said antenna having an electrical boresight, the method comprising:

analyzing the performance of said satellite communication system to determine an optimal electrical boresight pointing location for the electrical boresight of said antenna; and pointing the electrical boresight of said antenna at said optimal boresight pointing location.

2. The method of claim 1, wherein said analyzing step includes determining the electrical boresight pointing that minimizes the Co-Channel Interference (CCI) of said satellite communication system.

3. The method of claim 1, wherein said antenna directs a plurality of spot beams and said spot beams are arranged into at least one high density area, wherein said analyzing step includes determining the electrical boresight pointing by generally centering said electrical boresight on said high density area.

4. The method of claim 1, wherein said analyzing step includes, determining at least one of bit error rate (BER) and noise floor for the satellite communication system and determining the electrical boresight pointing that minimizes at least one of BER and noise floor said satellite communication system.

5. The method of claim 1, further including the step of:

reanalyzing the performance of said satellite communication system to determine a new optimal electrical boresight pointing location for the electrical boresight of said antenna.

6. The method of claim 5, wherein said reanalyzing step is performed at a network control center.

7. A system for increasing the performance of a satellite communication system, said system including:

a satellite having an antenna, said antenna having an electrical boresight, said electrical boresight pointing at an optimal boresight pointing location, said optimal boresight pointing location determined by analyzing the performance of said satellite communication system.

8. The system of claim 7, wherein said optimal boresight pointing location is determined by determining the electrical boresight pointing that minimizes the Co-Channel Interference (CCI) said satellite communication system.

9. The system of claim 7, wherein said antenna directs a plurality of spot beams and said spot beams are arranged into at least one high density area, and said optimal boresight pointing location is determined by determining the electrical boresight pointing by generally centering said electrical boresight on said high density area.

10. The system of claim 7, wherein said optimal boresight pointing location is determined by determining at least one of bit error rate (BER) and noise floor for the satellite communication system and determining the electrical boresight pointing that minimizes at least one of BER and noise floor said satellite communication system.

11. The system of claim 7, wherein the performance of said satellite communication system is reanalyzed to determine a new optimal electrical boresight pointing location for the electrical boresight of said antenna.

12. The system of claim 11, further including a network control center for reanalyzing the performance of said satellite communication system.

13. A satellite-based antenna of a satellite communication system, said antenna including:

an electrical boresight, said electrical boresight pointing at an optimal boresight pointing location, said optimal boresight pointing location determined by analyzing the performance of said satellite communication system.

14. The antenna of claim 13, wherein said optimal boresight pointing location is determined by determining the electrical boresight pointing that minimizes the Co-Channel Interference (CCI) said satellite communication system.

15. The antenna of claim 13, wherein said antenna directs a plurality of spot beams and said spot beams are arranged into at least one high density area, and said optimal boresight pointing location is determined by determining the electrical boresight pointing by generally centering said electrical boresight on said high density area.

16. The antenna of claim 13, wherein said optimal boresight pointing location is determined by determining at least one of bit error rate (BER) and noise floor for the satellite communication system and determining the electrical boresight pointing that minimizes at least one of BER and noise floor said satellite communication system.

17. The antenna of claim 13, wherein the performance of said satellite communication system is reanalyzed to determine an new optimal electrical boresight pointing location for the electrical boresight of said antenna.

18. The antenna of claim 17, further including a network control center for reanalyzing the performance of said satellite communication system.

* * * * *